US006812897B2

(12) United States Patent
Jarmuszewski et al.

(10) Patent No.: US 6,812,897 B2
(45) Date of Patent: Nov. 2, 2004

(54) DUAL MODE ANTENNA SYSTEM FOR RADIO TRANSCEIVER

(75) Inventors: Perry Jarmuszewski, Waterloo (CA); Yihong Qi, Waterloo (CA)

(73) Assignee: Research In Motion Limited, Waterloo (CA)

( * ) Notice: Subject to any disclaimer, the term of this patent is extended or adjusted under 35 U.S.C. 154(b) by 13 days.

(21) Appl. No.: 10/321,313

(22) Filed: Dec. 17, 2002

(65) Prior Publication Data

US 2004/0113849 A1 Jun. 17, 2004

(51) Int. Cl.[7] ..... H01Q 1/24
(52) U.S. Cl. ..... 343/702; 343/749
(58) Field of Search ..... 343/702, 749, 343/750, 880, 882, 895

(56) References Cited

U.S. PATENT DOCUMENTS

| | | | | |
|---|---|---|---|---|
| 3,521,284 A | | 7/1970 | Shelton, Jr. et al. | |
| 3,599,214 A | | 8/1971 | Altmayer | |
| 3,622,890 A | | 11/1971 | Fujimoto et al. | |
| 3,683,376 A | | 8/1972 | Pronovost | |
| 4,024,542 A | | 5/1977 | Ikawa et al. | |
| 4,173,761 A | * | 11/1979 | Liautaud | 343/715 |
| 4,325,069 A | * | 4/1982 | Hills | 343/750 |
| 4,471,493 A | | 9/1984 | Schober | |
| 4,504,834 A | | 3/1985 | Garay et al. | |
| 4,543,581 A | | 9/1985 | Nemet | |
| 4,571,595 A | * | 2/1986 | Phillips et al. | 343/745 |
| 4,584,709 A | | 4/1986 | Kneisel et al. | |
| 4,590,614 A | | 5/1986 | Erat | |
| 4,730,195 A | | 3/1988 | Phillips et al. | |
| 4,829,311 A | * | 5/1989 | Wells | 343/749 |
| 4,839,660 A | | 6/1989 | Hadzoglou | |
| 4,847,629 A | | 7/1989 | Shimazaki | |
| 4,857,939 A | | 8/1989 | Shimazaki | |
| 4,890,114 A | | 12/1989 | Egashira | |
| 4,894,663 A | | 1/1990 | Urbish et al. | |
| 4,975,711 A | | 12/1990 | Lee | |
| 5,030,963 A | | 7/1991 | Tadama | |
| 5,138,328 A | | 8/1992 | Zibrik et al. | |
| 5,214,434 A | | 5/1993 | Hsu | |
| 5,218,370 A | | 6/1993 | Blaese | |
| 5,227,804 A | | 7/1993 | Oda | |

(List continued on next page.)

FOREIGN PATENT DOCUMENTS

| | | |
|---|---|---|
| EP | 0543645 | 5/1993 |
| EP | 0571124 | 11/1993 |
| EP | 0765001 | 3/1997 |
| EP | 0814536 | 12/1997 |
| EP | 0892459 | 1/1999 |
| GB | 2330951 | 5/1999 |
| JP | 55147806 | 11/1980 |
| JP | 05007109 | 1/1993 |
| JP | 5129816 | 5/1993 |
| JP | 5267916 | 10/1993 |
| JP | 05347507 | 12/1993 |
| JP | 6204908 | 7/1994 |
| WO | 9638881 | 12/1996 |

(List continued on next page.)

OTHER PUBLICATIONS

Microwave Journal, May 1984, p. 242, advertisement of Solitron/Microwave, XP002032716.

*Primary Examiner*—Tho Phan
(74) *Attorney, Agent, or Firm*—Jones Day; Krishna K. Pathiyal; Robert Liang

(57) ABSTRACT

A dual mode antenna system for a wireless transceiver is provided, and includes a retractable antenna element having a first, retracted position and a second, extended position. The antenna element operates as a first type of antenna in the first position and a second type of antenna in the second position. In the first position, the retractable antenna element is connected to a loading structure to form a low-profile antenna, and in the second position, the antenna element forms a monopole antenna.

48 Claims, 2 Drawing Sheets

U.S. PATENT DOCUMENTS 5,245,350 A 9/1993 Sroka
5,257,032 A 10/1993 Diamond et al.
5,347,291 A 9/1994 Moore
5,373,300 A 12/1994 Jenness et al.
5,422,651 A 6/1995 Chang
5,451,965 A 9/1995 Matsumoto
5,451,968 A 9/1995 Emery
5,457,469 A 10/1995 Diamond et al.
5,493,702 A 2/1996 Crowley et al.
5,594,459 A * 1/1997 Hirota ..... 343/749
5,684,672 A 11/1997 Karidis et al.
5,767,811 A 6/1998 Mandai et al.
5,821,907 A 10/1998 Zhu et al.
5,841,403 A 11/1998 West
5,870,066 A 2/1999 Asakura et al.
5,872,546 A 2/1999 Ihara et al.
5,903,240 A 5/1999 Kawahata et al.
5,966,098 A 10/1999 Qi et al.
5,973,651 A 10/1999 Suesada et al.
5,977,920 A 11/1999 Hung
5,990,838 A 11/1999 Burns et al.
6,028,568 A 2/2000 Asakura et al.
6,031,505 A 2/2000 Qi et al.
6,229,489 B1 * 5/2001 Holshouser et al. ..... 343/702
6,329,951 B1 12/2001 Wen et al.
6,337,667 B1 1/2002 Ayala et al.

FOREIGN PATENT DOCUMENTS

WO 9733338 12/1997
WO 9812771 3/1998
WO 9903166 1/1999
WO 9925042 5/1999
WO 0001028 1/2000
WO 0178192 10/2001

* cited by examiner

DUAL MODE ANTENNA SYSTEM FOR RADIO TRANSCEIVER

FIELD OF THE INVENTION

This invention relates generally to the field of antennas. More specifically, a dual position antenna is provided that is particularly well-suited for use with a radio transceivers such as radio modems.

BACKGROUND OF THE INVENTION

Communication devices having radio transceivers are known. Many types of antenna structures are also known, including helix, "inverted F", and retractable antenna structures, for example. Helix and retractable antennas are typically installed outside of a mobile device, and inverted F antennas are typically embedded inside a case or housing of a device. In general, helix antennas and embedded antennas such as inverted F antennas have a single operating mode. Although an internal antenna may operate when a device in which the internal antenna is installed is oriented in different directions, the operating mode of the antenna itself does not change. Similarly, retractable antennas are typically optimized to operate when the antenna is in an extended position.

In some circumstances, such as in PCMCIA radio modems, for example, internal space limitations preclude the use of high-performance embedded antennas. However, fixed external antennas for such devices are often inconvenient when a device must be stored or handled. Retractable antennas improve storage and handling, but known designs are more intrusive when in use, requiring antennas to be extended for operation.

SUMMARY

A dual mode antenna system for a wireless transceiver is provided. The antenna system comprises a retractable antenna element having a retracted position and an extended position, and a loading structure. The antenna element is connected to the loading structure in the retracted position and operates in a first operating mode, and is disconnected from the loading structure and operates in a second operating mode in the extended position.

According to another embodiment of the invention, an antenna system comprises a dual position antenna having a first position and a second position, wherein the dual position antenna operates as a first type of antenna in the first position and as a second type of antenna in the second position.

In a still further embodiment, an antenna system comprises a top load and a retractable antenna element. The retractable antenna element has a retracted position and an extended position. In the retracted position, the retractable antenna element is connected to the top load to form a low-profile antenna. In the extended position, the antenna element forms a monopole antenna.

Further features of dual mode antenna systems will be described or will become apparent in the course of the following detailed description.

DETAILED DESCRIPTION

Figure 1:
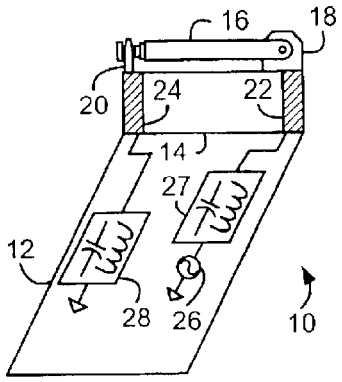
FIG. 1 is an isometric view of a dual mode antenna system with an antenna element in a first position.

FIG. 1 is an isometric view of a dual mode antenna system with an antenna element in a first position. The antenna system 10 includes an antenna element 16 and a loading structure 24. The antenna element 16 is a dual position retractable antenna, shown in FIG. 1 in its retracted position. The antenna system 10 also includes a mounting structure 18, a conductive clip 20, conductor 22, a feeding port 26, a matching circuit 27, and a loading circuit 28. The components of the antenna system 10 are mounted on a first printed circuit board (PCB) 12 and a second PCB 14. Further components of a wireless transceiver with which the antenna system 10 is configured to operate have not been shown in FIG. 1, but are also mounted on the first and second PCBs 12 and 14.

Signals to be transmitted by the antenna element 16 are input to a feeding port 26. The feeding port 26 also outputs signals received by the antenna element 16. The antenna element 16 is coupled to the feeding port 26 through the mounting structure 18 and the conductor 22. The conductor 22 is preferably fabricated from a conductive material such as copper, for example, printed on the second PCB 14. The antenna element 16 is similarly connected to the loading structure 24 through the conductive clip 20. The conductive clip 20 also preferably retains the antenna element 16 in the position shown in FIG. 1.

The matching circuit 27, as will be obvious to those skilled in the art, is provided to match the impedance of the antenna system 10 to the impedance of the transceiver with which the antenna system 10 operates.

In the first position shown in FIG. 1, the antenna system 10 operates as a first type of antenna in a first operating mode. The conductor 22 and the antenna element 16 form an L-shape, for which the loading structure 24 and the loading circuit 28 are a top load. In this first position, the antenna system 10 thereby forms a low-profile antenna. Unlike known retractable antennas, the antenna 16 is optimized for transmitting and receiving communication signals in both its extended and retracted positions. The retracted length of the antenna element 16, the electrical lengths of the conductor 22 and the loading structure 24, the matching circuit 27, and the loading circuit 28 set the operating frequency and gain of the antenna system 10. Those skilled in the art will appreciate that meander structures may be incorporated into the conductor 22 and the load structure 24 to increase the electrical lengths thereof.

Figure 2:
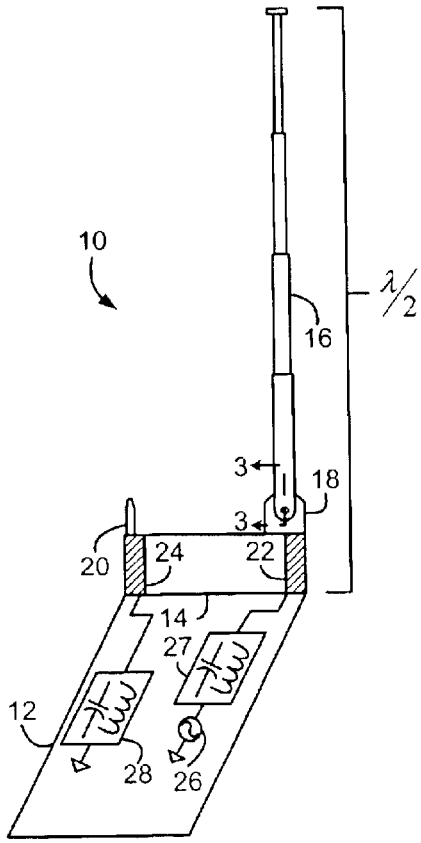
FIG. 2 is an isometric view of the dual mode antenna system in FIG. 1 with the antenna element in a second position.

FIG. 2 is an isometric view of the dual mode antenna system in FIG. 1 with the antenna element in a second position. Although the components of the antenna system 10 are the same in FIGS. 1 and 2, the operation of the antenna system 10 with the antenna element 16 in its second, extended position is not the same, as described in further detail below.

A dual position antenna such as the antenna element 16 is typically pivotally mounted at one end. When such an antenna is to be extended, it is pivoted into an upright position from the low-profile position and then extended. The antenna element 16 is first released from the conductive clip 20, thereby disconnecting it from the loading structure 24 and the loading circuit 28, and rotated into an upright position before it is extended. As shown, the total extended length of the antenna element 16, the mounting structure 18, and the conductor 22 is one half the wavelength, λ, of an operating frequency of the antenna system 10. Although shown as a half-λ monopole antenna in FIG. 2, those skilled in the art will appreciate that the antenna element 16 may alternatively be configured to form other types of monopole antenna when extended.

In its extended position, the antenna element 16 is disconnected from the loading structure 24 and operates in a second operating mode as a second type of antenna. As described above, the antenna system 10 forms a low-profile antenna when the antenna element 16 is in its first, retracted position. With the antenna element 16 in its second, extended position, the antenna system 10 operates as a monopole antenna. The matching circuit 27 matches the impedance of the antenna system 10, when the antenna element 16 is in its extended position, to the impedance of a transceiver with which the antenna system 10 operates. Monopole antennas and their principles of operation will be apparent to those skilled in the art.

Thus, the antenna system 10 includes a dual position and dual mode retractable antenna having retracted and extended positions. When in its retracted position, the antenna is compact and operable in a first operating mode as a first type of antenna. The first operating mode provides for communication signal reception and transmission in favorable signal conditions with a low-profile antenna. Although the matching circuit 27 matches the impedance of the antenna system 10 to a transceiver when the antenna system 10 is in its extended position, the dimensions of the loading structure 24 and the characteristics of the loading circuit 28 affect antenna gain and match of the antenna system 10 when the antenna element 16 is in its retracted position. The loading structure 24 and the loading circuit 28 are preferably adjusted to maintain impedance match between the antenna system 10 and the transceiver when the antenna element 16 is in its retracted position. It will be appreciated by those skilled in the art that in alternative embodiments, a top load for the antenna element 16 when in its retracted position may include only the loading structure 24 or the loading circuit 28.

The antenna operates in a second operating mode as a second type of antenna in its extended position. Where better antenna performance is required, such as in weaker coverage areas of a wireless communication network, the antenna element 16 is extended. A user of a wireless transceiver with which the antenna system 10 operates therefore has the option of using the antenna system 10 with the antenna element 16 retracted or extended, based on current signal conditions.

Figure 3:
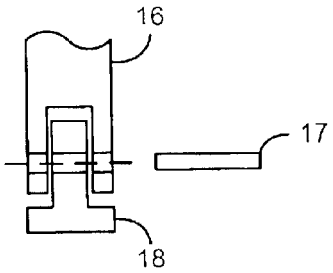
FIG. 3 is a cross-sectional view along the line 3—3 of FIG. 2.

Having described the operation of the antenna system 10, some of its structural elements will now be described in further detail. FIG. 3 is a cross-sectional view along the line 3—3 of FIG. 2, but with a mounting pin displaced from its normal position for illustrative purposes. The mounting structure 18 pivotally attaches the antenna element 16 to a wireless transceiver or a housing or structural member of the wireless transceiver or a communication device incorporating the wireless transceiver. In FIG. 3, the mounting structure 18 and a mounting end of the antenna element 16 include through holes or bores which, when aligned, receive a mounting pin 17 to retain the antenna element 16 on the mounting structure 18. The mounting pin 17 may be a screw or a rivet, for example. Other types of mounting arrangements for attaching the antenna element 16 to the mounting structure 18, such as a ball and socket joint or cooperating detents and notches may alternatively be used.

The mounting structure 18 is itself mounted on a wireless transceiver or communication device. Depending upon how the antenna element 16 is mounted to the mounting structure 18, different types of attachment may be used to mount the mounting structure. For example, where a mounting pin 17 is used to pivotally mount the antenna element 16 on the mounting structure 18, a rotatable attachment mechanism for the mounting structure 18 provides a further degree of freedom for orienting the antenna element 16 in its extended position. The antenna element 16 can then be both pivoted on the mounting structure 18 and rotated on the wireless transceiver or device. Where the mounting arrangement between the antenna element 16 and the mounting structure 18 allows rotation of the antenna element 16 in more than one direction, however, as with a ball and socket joint, the mounting structure 18 could be fixedly mounted to the wireless transceiver or device.

Electrical connection between the conductor 22 and the antenna element 16 is also dependent upon how the antenna element 16 is mounted to the wireless transceiver or device. Where each component of the mounting arrangement is electrically conductive, the antenna element 16 is preferably coupled to the conductor 22 through the mounting structure 18. In FIG. 3, for example, the mounting structure 18 and the mounting pin 17 are preferably electrically conductive, and the mounting structure 18 is connected to the conductor 22 through cooperating connectors on the mounting structure 18 and the wireless transceiver or wireless device. In a preferred embodiment, the mounting structure 18 is mounted to the wireless transceiver or device using a rotatable electrically conductive connector connected to the conductor 22. One such connector comprises a post at the bottom of the mounting structure 18 and a conductive ring or cup connected to the conductor 22 and configured to receive and retain the post. Other connection arrangements, including conductive wires, are also contemplated.

The conductive clip 20 is preferably manufactured from, or at least includes, a conductive material. In one embodiment, the conductive clip 20 includes a pair of leaf springs biased toward each other to receive and retain a portion of the antenna element 16. The dimensions of the conductive clip 20 are preferably selected to accommodate only an uppermost section of the antenna element 16, such that the antenna element 16 can be inserted into the conductive clip 20 only after it has been retracted, thereby ensuring proper operation of the antenna system 10 in its first operating mode with the antenna element 16 in its retracted position. The conductive clip 20 may also be designed such that the antenna element 16 is coupled to the loading structure 24 and the loading circuit 28 only when it has been properly inserted into the conductive clip 20, by providing an electrical connection between a portion of the conductive clip 20 that contacts the antenna element 16 and the loading structure 24. The antenna element 16 is then coupled to the loading structure 24 and the loading circuit 28 only when it has been collapsed and inserted into the conductive clip 20, not when the antenna element 16 merely comes into contact with another portion of the conductive clip 20. The present invention is in no way limited to a leaf spring type of conductive clip 20. Alternative components suitable for retaining the antenna element 16 in the first position shown in FIG. 1, including a fixed hook-type component commonly used in conjunction with retractable antennas, for example, manufactured from or including an electrical conductor coupled to the loading structure 24, will be apparent to those skilled in the art and are considered to be within the scope of the present invention.

The conductive clip 20 may be electrically connected to the loading structure 24 via any of a plurality of different types of connection. Where the conductive clip is entirely conductive, the conductive clip 20 may be mounted to a wireless transceiver or device in direct physical contact with a portion of the loading structure 24. Alternatively, a conductive wire or other conductive member may be provided to connect the loading structure 24 to the conductive clip 20. If only a portion of the conductive clip 20 is conductive or incorporates a conductor, then this conductive part or conductor may be similarly connected to the loading structure 24.

Figure 4:
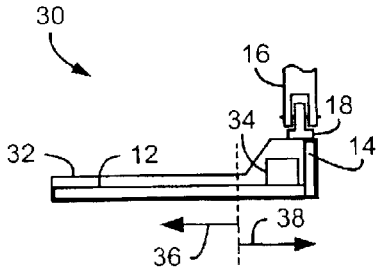
FIG. 4 is a side view of a wireless modem incorporating a dual mode antenna system.

FIG. 4 is a side view of a wireless modem incorporating a dual mode antenna system. Although the dual mode antenna system of FIG. 4 preferably includes the elements and components described above, only the first and second PCBs 12 and 14, the antenna element 16, and the mounting structure 18 are visible from the perspective shown in FIG. 4. The wireless modem 30 is a PCMCIA card-type modem designed to be inserted into a compatible card slot on a computer. Such modems are most widely used in conjunction with laptop computers.

A wireless transceiver and other systems of the wireless modem 30 are fabricated on the first and second PCBs 12 and 14, which in FIGS. 1–4 are substantially perpendicular and may therefore be considered a horizontal PCB and a vertical PCB, respectively. Internal components of the modem 30, including a battery 34, are substantially enclosed in a housing 32 which is preferably fabricated from a metal or plastic material. Although shown as a single housing in FIG. 4, the housing 32 may alternatively comprise distinct but cooperating housing sections, each of which may be fabricated from the same or different materials.

Although the battery 34 is substantially larger than most other components of the modem 30, enclosure of the battery 34 in the housing 32 also provides interior space for the second PCB 14. However, the battery 34 is larger than most known card slots. As such, the modem 30 has two sections, an insertion section 36 and an external section 38. The insertion section 36 is sized for insertion into a card slot, approximately 5.5 cm in width by 9 cm in length, whereas the external section 38 remains outside the card slot. As will be apparent to those skilled in the art, the insertion section 36 includes an aperture or opening through which corresponding connectors in the modem 30 and the card slot are connected.

The portion of the housing 32 which encloses the external section 38 may also incorporate one or more openings, such as a battery compartment opening with a removable cover to provide access to the battery 34, which is either a rechargeable battery or a single-use battery. Where the modem 30 is used with a device having a relatively limited power source, such as a palmtop computer, a personal digital assistant (PDA), a mobile telephone, or another portable electronic device, then a single-use battery or a rechargeable battery that is removed from the modem 30 for recharging is generally preferable. Alternatively, if the modem 30 is used with a device having a higher capacity power source, a rechargeable battery designed to be recharged through the card slot may instead be used. The mounting structure 18 and the conductive clip 20 are also connected to the conductor 22 and the loading structure 24 through the housing 32, as described above.

The modem 30 enables a computer or other device with a compatible card slot for data communications. When the insertion section 36 of the modem 30 has been inserted into the card slot, the antenna element 16 may be oriented in its retracted position or its extended position, and the computer or device may then send and receive communication signals via a wireless communication network in which the modem is configured to operate.

Figure 5:
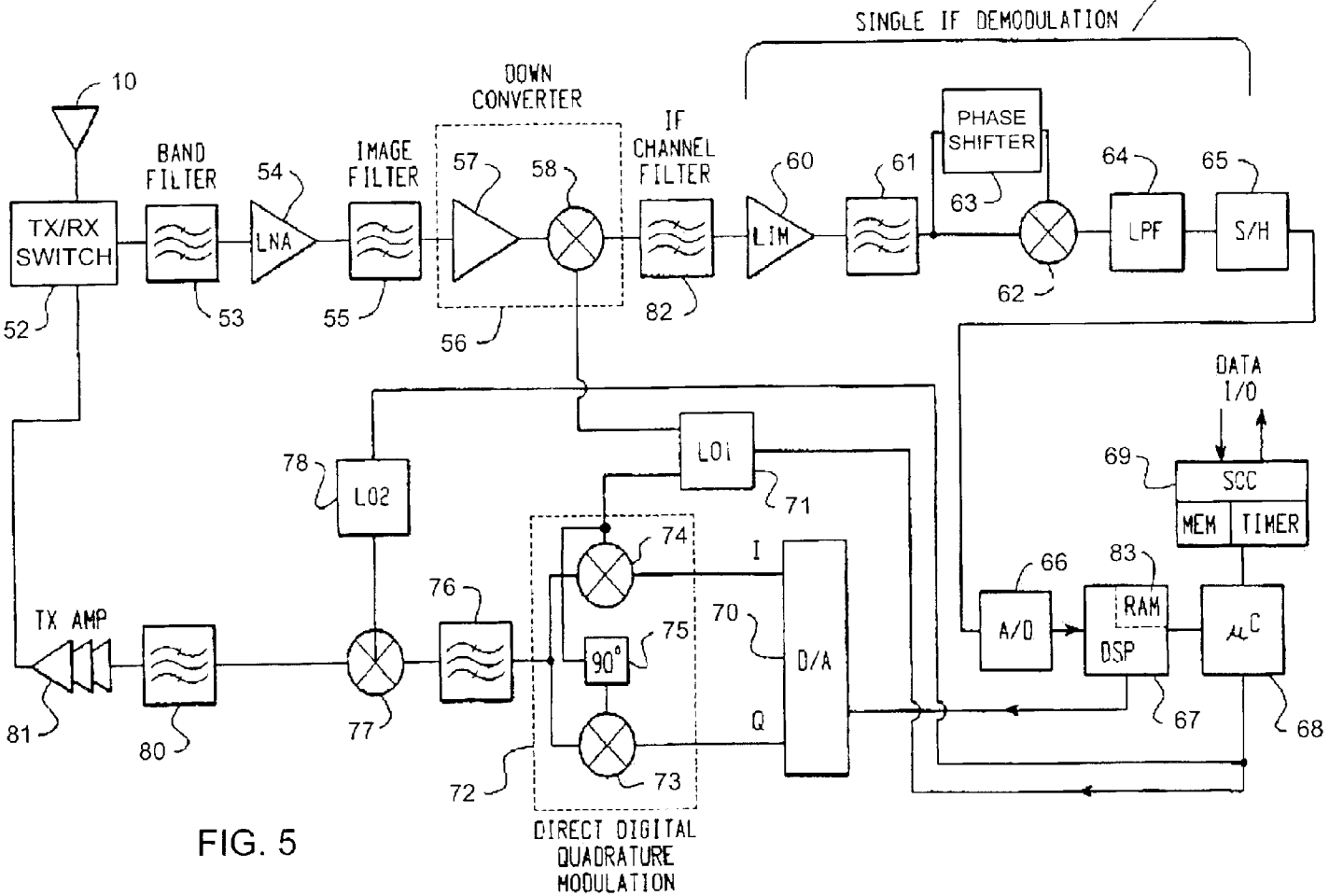
FIG. 5 is a block diagram of a radio modem.

FIG. 5 is a block diagram of a radio modem, as one embodiment of a wireless transceiver with which a dual mode antenna system may be used.

A received signal is conveyed from the dual mode antenna system 10 via a transmit/receive switch 52 to a band filter 53, which, in a preferred embodiment, is a electronically-coupled piezoelectric device such as an acoustic wave device. The filtered signal is conveyed to a low-noise amplifier (LNA) 54 and image filter 55, and to the downconverter 56. Within the downconverter 56, the signal amplified by a limiter 57 is mixed with a signal from a local oscillator 71 at the mixer 58 to produce a signal at an intermediate frequency (IF) greater than or equal to 10.7 MHz, whereupon it is conditioned by the IF channel filter 82. The resulting IF signal is demodulated with the discriminator 59. In an embodiment of the radio modem designed for operation in the Mobitex™ radio network, the intermediate frequency is preferably 45 MHz.

The discriminator 59 includes a limiting amplifier 60 to produce a signal having constant amplitude. This signal is passed through a filter 61 and split into two parts that are mixed in a mixer 62, with one of the parts shifted in phase relative to the other. The phase shift element 63 is preferably an electronically-coupled piezoelectric device such as surface acoustic wave filter or a crystal filter. The demodulated signal is conditioned by a low-pass filter 64 and converted to a digital representation before being conveyed to a digital signal processor 67. The conversion to a digital representation is performed by a sample-and-hold circuit 65, and an analog-to-digital converter 66. The digital data is conveyed to the computer or device in which the modem is installed via the microcontroller 68 and a serial communications controller 69.

When the radio modem is transmitting, the data to be sent is conveyed from the computer or device via the serial communications controller 69 and the microcontroller 68 to the digital signal processor 67. The digital signal processor 67 generates the appropriate in-phase and quadrature-phase modulated waveform segments, which are based on the current and previous bits to be sent, from a precalculated look-up table stored in the associated random-access memory 83. The digital signals are converted to analog signals by the digital-to-analog converter 70 and are conveyed to the quadrature modulator 72. Within the quadrature modulator 72 the in-phase signal is mixed in a mixer 74 with the signal from the local oscillator 71, and the quadrature-phase signal is mixed in a mixer 73 with a ninety-degree phase shifted signal from the local oscillator 71 supplied via the phase shift element 75. The emerging modulated signal is passed through a bandpass filter 76, and input to an upconverter mixer 77, where it is mixed with a signal from the local oscillator 78. The upconverted signal is conditioned by a band-pass filter 80 and is amplified in a three-stage power amplifier 81 and is transmitted from the dual-mode antenna system 10 via the transmit/receive switch 52.

Although the present invention has been described and illustrated in detail, the description is meant to be illustrative and not limiting the spirit or scope of the invention, which is limited and defined with particularity only by the terms of the appended claims.

For example, a wireless transceiver need not incorporate the two PCBs described above. Dual mode antenna systems according to aspects of the invention are in no way dependent upon multiple circuit boards, and may be implemented in conjunction with wireless transceivers having a single PCB or more than two PCBs.

Those skilled in the art will also appreciate that the antenna system 10 may include more than the single feeding port 26 shown in FIGS. 1 and 2. A second feeding port may, for example, be connected to the conductor 22 for connection to ground.

In addition, the invention could be implemented differently than shown in FIG. 4. A dual mode antenna system need not necessarily be mounted on any particular surface of a wireless transceiver, modem, or other device. In FIG. 4, the antenna system is mounted on a surface which is a top surface when the modem has been inserted into a card slot on a computer. However, the antenna system could be mounted on another surface without departing from the present invention.

Further, a dual mode antenna system may be used with other wireless transceivers than the modem depicted in FIG. 5 and described above. The modem in FIG. 5 is presented solely for the purpose of illustration. Other wireless transceiver designs will be apparent to those skilled in the art.

What is claimed as the invention is:

1. A dual mode antenna system for a wireless transceiver, comprising:

a loading structure;

a retractable antenna element having a retracted position in which the antenna element is connected to the loading structure and operates in a first operating mode, and an extended position in which the antenna element is disconnected from the loading structure and operates in a second operating mode; and a conductive clip coupled to the loading structure, wherein the conductive clip connects the loading structure to the antenna element when the antenna element is in the retracted position.

2. The dual mode antenna system of claim 1, wherein the retractable antenna element is pivotally mounted to a mounting structure.

3. The dual mode antenna system of claim 2, wherein the wireless transceiver is substantially enclosed within a housing, and wherein the mounting structure is rotatably mounted to the housing.

4. The dual mode antenna system of claim 3, wherein the mounting structure further comprises a post, and wherein the housing further comprises a conductive ring configured to receive and retain the post to thereby rotatably mount the mounting structure to the housing.

5. The dual mode antenna system of claim 2, further comprising a mounting pin, wherein the mounting pin pivotally mounts the antenna element on the mounting structure.

6. The dual mode antenna system of claim 1, further comprising a loading circuit connected to the loading structure.

7. The dual mode antenna system of claim 1, wherein the wireless transceiver comprises a first printed circuit board and a second printed circuit board.

8. The dual mode antenna system of claim 1, further comprising a matching circuit connected to the antenna element when the antenna element is in the retracted position and the extended position.

9. An antenna system comprising:

a dual position antenna having a first position and a second position, wherein the dual position antenna operates as a first type of antenna in the first position and as a second type of antenna in the second position;

a loading structure coupled to the dual position antenna; and a conductive clip coupled to the loading structure and configured to receive and retain a portion of the dual position antenna when the dual position antenna is in the first position.

10. The antenna system of claim 9, wherein the first type of antenna is a low-profile antenna.

11. The antenna system of claim 10, wherein the second type of antenna is a monopole antenna.

12. The antenna system of claim 11, wherein the dual position antenna has a first end and a second end, wherein the antenna system further comprises a feeding port, a matching circuit, and a conductor connected to one end of the dual position antenna, and wherein the conductor and the dual position antenna form the monopole antenna when the dual position antenna is in the second position.

13. The antenna system of claim 9, wherein the dual position antenna is connected to the loading structure in the first position, and wherein the conductor, the dual position antenna, and the loading structure form the low-profile antenna when the dual position antenna is in the first position.

14. The antenna system of claim 13, further comprising a mounting structure rotatably connected to the conductor and pivotally connected to the first end of the dual position antenna.

15. The antenna system of claim 13, wherein the conductor and the loading structure are printed on a printed circuit board.

16. An antenna system implemented in a wireless modem, wherein the wireless modem comprises an insertion section configured for insertion into a card slot of an electronic device, and an external section, comprising:

a top load; and a retractable antenna element having a retracted position and an extended position, wherein, in the retracted position, the retractable antenna element is connected to the top load to form a low-profile antenna, and in the extended position, the antenna element forms a monopole antenna.

17. The antenna system of claim 16, wherein the antenna system is mounted on the external section.

18. The antenna system of claim 16, wherein the electronic device is selected from the group consisting of: a desktop computer system, a laptop computer system, a palmtop computer system, a personal digital assistant (PDA, a mobile telephone, and a portable electronic device.

19. A dual mode antenna system for a wireless transceiver, comprising:

a loading structure;

a retractable antenna element having a retracted position in which the antenna element is coupled to the loading structure and operates in a first operating mode, and an extended position in which the antenna element is decoupled from the loading structure and operates in a second operating mode; and a conductive clip, and equivalents thereof, coupled to the loading structure, wherein the conductive clip couples the loading structure to the antenna element when the antenna element is in the retracted position.

20. The dual mode antenna system of claim 19, wherein the retractable antenna element is pivotally mounted to a mounting structure.

21. The dual mode antenna system of claim 20, wherein the wireless transceiver is substantially enclosed within a housing, and wherein the mounting structure is rotatably mounted to the housing.

22. The dual mode antenna system of claim 21, wherein the mounting structure further comprises a post, and wherein the housing further comprises a conductive ring configured to receive and retain the post to thereby rotatably mount the mounting structure to the housing.

23. The dual mode antenna system of claim 20, further comprising a mounting pin, wherein the mounting pin pivotally mounts the antenna element on the mounting structure.

24. The dual mode antenna system of claim 19, further comprising a loading circuit coupled to the loading structure.

25. The dual mode antenna system of claim 19, wherein the wireless transceiver comprises a first printed circuit board and a second printed circuit board.

26. The dual mode antenna system of claim 19, further comprising a matching circuit coupled to the antenna element when the antenna element is in the retracted position and the extended position.

27. An antenna system comprising:

a dual position antenna having a first position and a second position, wherein the dual position antenna operates as a first type of antenna in the first position and as a second type of antenna in the second position;

a loading element coupled to the dual position antenna; and a conductive clip, and equivalents thereof, coupled to the loading structure and configured to receive and retain a portion of the dual position antenna when the dual position antenna is in the first position.

28. The antenna system of claim 27, wherein the first type of antenna is a low-profile antenna.

29. The antenna system of claim 28, wherein the second type of antenna is a monopole antenna.

30. The antenna system of claim 29, wherein the dual position antenna has a first end and a second end, wherein the antenna system further comprises a feeding port, a matching circuit, and a conductor connected to one end of the dual position antenna, and wherein the conductor and the dual position antenna form the monopole antenna when the dual position antenna is in the second position.

31. The antenna system of claim 27, wherein the dual position antenna is connected to the loading element in the first position, and wherein the conductor, the dual position antenna, and the loading element form the low-profile antenna when the dual position antenna is in the first position.

32. The antenna system of claim 31, further comprising a mounting structure rotatably coupled to the conductor and pivotally connected to the first end of the dual position antenna.

33. The antenna system of claim 31, wherein the conductor and the loading element are printed on a printed circuit board.

34. A dual mode antenna system for a wireless transceiver, comprising:

a loading element;

a retractable antenna element having a retracted position in which the antenna element is coupled to the loading element and operates in a first operating mode, and an extended position in which the antenna element is decoupled from the loading element and operates in a second operating mode; and means for coupling the loading structure to the antenna element when the antenna element is in the retracted position.

35. The dual mode antenna system of claim 34, wherein the retractable antenna element is pivotally mounted to a mounting structure.

36. The dual mode antenna system of claim 35, wherein the wireless transceiver is substantially enclosed within a housing, and wherein the mounting structure is rotatably mounted to the housing.

37. The dual mode antenna system of claim 36, wherein the mounting structure further comprises a post, and wherein the housing further comprises a conductive ring configured to receive and retain the post to thereby rotatably mount the mounting structure to the housing.

38. The dual mode antenna system of claim 35, further comprising a mounting pin, wherein the mounting pin pivotally mounts the antenna element on the mounting structure.

39. The dual mode antenna system of claim 34, further comprising a loading circuit coupled to the loading element.

40. The dual mode antenna system of claim 34, wherein the wireless transceiver comprises a first printed circuit board and a second printed circuit board.

41. The dual mode antenna system of claim 34, further comprising a matching circuit coupled to the antenna element when the antenna element is in the retracted position and the extended position.

42. An antenna system comprising:

a dual position antenna having a first position and a second position, wherein the dual position antenna operates as a first type of antenna in the first position and as a second type of antenna in the second position;

a loading element coupled to the dual position antenna; and means, coupled to the loading element, for receiving and retaining a portion of the dual position antenna when the dual position antenna is in the first position.

43. The antenna system of claim 42, wherein the first type of antenna is a low-profile antenna.

44. The antenna system of claim 43, wherein the second type of antenna is a monopole antenna.

45. The antenna system of claim 44, wherein the dual position antenna has a first end and a second end, wherein the antenna system further comprises a feeding port, a matching circuit, and a conductor connected to one end of the dual position antenna, and wherein the conductor and the dual position antenna form the monopole antenna when the dual position antenna is in the second position.

46. The antenna system of claim 42, wherein the dual position antenna is connected to the loading element in the first position, and wherein the conductor, the dual position antenna, and the loading element form the low-profile antenna when the dual position antenna is in the first position.

47. The antenna system of claim 46, further comprising a mounting structure rotatably coupled to the conductor and pivotally connected to the first end of the dual position antenna.

48. The antenna system of claim 46, wherein the conductor and the loading element are printed on a printed circuit board.

* * * * *